US006304631B1

(12) United States Patent
Snyder

(10) Patent No.: US 6,304,631 B1
(45) Date of Patent: Oct. 16, 2001

(54) X-RAY TUBE VAPOR CHAMBER TARGET

(75) Inventor: Douglas J. Snyder, Brookfield, WI (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/472,549

(22) Filed: Dec. 27, 1999

(51) Int. Cl.[7] ..... H01J 35/10
(52) U.S. Cl. ..... 378/130; 378/141
(58) Field of Search ..... 378/130, 141, 378/143, 132, 131, 144; 313/35, 330

(56) References Cited

U.S. PATENT DOCUMENTS

| | | | | |
|---|---|---|---|---|
| 3,719,847 | | 3/1973 | Webster | 313/60 |
| 3,735,175 | | 5/1973 | Blomgren, Jr. | 313/60 |
| 4,130,772 | * | 12/1978 | Kussel et al. | 313/32 |
| 4,146,815 | | 3/1979 | Childeric | 313/330 |
| 4,165,472 | | 8/1979 | Wittry | 313/35 |
| 4,276,493 | * | 6/1981 | Srinivasa et al. | 313/330 |
| 4,501,566 | * | 2/1985 | Carlson et al. | 445/28 |
| 4,622,687 | * | 11/1986 | Whitaker et al. | 378/130 |
| 5,486,703 | * | 1/1996 | Lovin et al. | 250/492.3 |
| 5,742,662 | | 4/1998 | Kuhn et al. | 378/138 |
| 6,215,852 | * | 4/2001 | Rogers et al. | 378/142 |

* cited by examiner

*Primary Examiner*—Robert H. Kim
*Assistant Examiner*—Irakli Kiknadze
(74) *Attorney, Agent, or Firm*—Foley & Lardner; Christian G. Cabou

(57) ABSTRACT

An x-ray tube for emitting x-rays includes a housing, an anode assembly disposed in the housing and including a target surface, a cathode assembly mounted in the housing at a distance from the anode assembly, and a target body extending from the target surface of the anode assembly. The cathode assembly includes an electron emitter which emits electrons. The electrons hit the target surface of the anode assembly and produce x-rays. The target body has a cavity containing a working fluid and is configured to transfer thermal energy away from the target surface.

21 Claims, 4 Drawing Sheets

X-RAY TUBE VAPOR CHAMBER TARGET

BACKGROUND OF THE INVENTION

The present invention relates generally to imaging systems. More particularly, the present invention relates to an x-ray tube anode with enhanced thermal performance.

Electron beam generating devices, such as x-ray tubes and electron beam welders, operate in a high temperature environment. In an x-ray tube, for example, the primary electron beam generated by the cathode deposits a very large heat load in the anode target to the extent that the target glows red-hot in operation. Typically, less than 1% of the primary electron beam energy is converted into x-rays, while the balance is converted to thermal energy. This thermal energy from the hot target is radiated to other components within the vacuum vessel of the x-ray tube, and is removed from the vacuum vessel by a cooling fluid circulating over the exterior surface of the vacuum vessel. Additionally, some of the electrons back scatter from the target and impinge on other components within the vacuum vessel, causing additional heating of the x-ray tube. As a result of the high temperatures caused by this thermal energy, the x-ray tube components are subject to high thermal stresses which are problematic in the operation and reliability of the x-ray tube.

Typically, an x-ray beam generating device, referred to as an x-ray tube, comprises opposed electrodes enclosed within a cylindrical vacuum vessel. The vacuum vessel is typically fabricated from glass or metal, such as stainless steel, copper or a copper alloy. As mentioned above, the electrodes comprise the cathode assembly that is positioned at some distance from the target track of the rotating, disc-shaped anode assembly. Alternatively, such as in industrial applications, the anode may be stationary.

The target track, or impact zone, of the anode is generally fabricated from a refractory metal with a high atomic number, such as tungsten or tungsten alloy. A typical voltage difference of 60 kV to 140 kV is maintained between the cathode and anode assemblies to accelerate the electrons. The hot cathode filament emits thermal electrons that are accelerated by the potential difference, impacting the target zone of the anode at high velocity. A small fraction of the kinetic energy of the electrons is converted to high energy electromagnetic radiation, or x-rays, while the balance is contained in back scattered electrons or converted to heat. The x-rays are emitted in all directions, emanating from the focal spot, and may be directed out of the vacuum vessel.

In an x-ray tube having a metal vacuum vessel, for example, an x-ray transmissive window is fabricated into the metal vacuum vessel to allow the x-ray beam to exit at a desired location. After exiting the vacuum vessel, the x-rays are directed to penetrate an object, such as human anatomical parts for medical examination and diagnostic procedures. The x-rays transmitted through the object are intercepted by a detector and an image is formed of the internal anatomy. Further, industrial x-ray tubes may be used, for example, to inspect metal parts for cracks or to inspect the contents of luggage at airports.

Since the production of x-rays in an x-ray tube is by its nature a very inefficient process, the components in x-ray generating devices operate at elevated temperatures. For example, the temperature of the anode focal spot can run as high as about 2500° C., while the temperature in the other parts of the anode may range up to about 1800° C. Additionally, the components of the x-ray tube insert must be able to withstand the high temperature exhaust processing of the x-ray tube, at temperatures that may approach approximately 450° C. for a relatively long duration.

To cool the x-ray tube insert, the thermal energy generated during tube operation must be transferred from the anode through the vacuum vessel and be removed by a cooling fluid. The vacuum vessel is typically enclosed in a casing filled with circulating, cooling fluid, such as dielectric oil. The casing supports and protects the x-ray tube and provides for attachment to a computed tomography (CT) system gantry or other structure. Also, the casing is lined with lead to provide stray radiation shielding.

In conventional systems, extra performance from increased heat dissipation is achieved by increasing the diameter and mass of the target to increase the heat storage and radiating surface area of the target. Nevertheless, increasing the diameter and mass of the target is not easily done for the following reasons: (1) Increasing the diameter of the target is limited due to space constraints on the scanning system. Space constraints are particularly applicable to x-ray systems due to the desire to have good angulation capability. (2) Faster scanning on the CT gantry increases the mechanical loads on the entire x-ray tube. Hence, faster scanning tends to drive the mass of the target downward, which conflicts with the thermal performance of the x-ray tube. (3) Thickening the target will provide little benefit for high power scans since there is a finite amount of time required for the heat to conduct from the track of the target (i.e., the region where the electron beam hits the target) to other regions of the target. As such, the heat energy may not even reach the back of the target until the scan has ended. Therefore, adding extra mass to the back of the target will give little to no extra benefit with respect to thermal performance.

Thus, there is a need for an improved method of dissipating heat from the anode of the x-ray tube. Further, there is a need for an x-ray tube which provides greatly enhanced heat dissipation at the track and for the entire target, resulting in the capability to do longer and more powerful x-ray scans. Such an x-ray tube would beneficially operate with lower track temperature. Even further, there is a need for an x-ray tube which provides lower mass and smaller targets for a given power rating, enabling higher gantry speeds on CT systems or better angulation on x-ray systems.

BRIEF SUMMARY OF THE INVENTION

One embodiment of the invention relates to an x-ray tube for emitting x-rays which includes an anode assembly and a cathode assembly. The x-ray tube includes a casing, an anode assembly disposed in the casing and including a target surface, a cathode assembly mounted in the casing at a distance from the anode assembly, and a target body extending from the target surface of the anode assembly. The cathode assembly includes an electron emitter which emits electrons. The electrons hit the target surface or track of the anode assembly and produce x-rays. The target body includes a cavity containing a working fluid and is configured to transfer thermal energy away from the target surface or track. Advantageously, the x-ray tube may include a large surface target to radiate thermal energy to a cooled surface.

Another embodiment of the invention relates to an x-ray tube for emitting x-rays with increased performance by effective heat dissipation. The x-ray tube includes an electron source emitting electrons, which strike the track in order to produce x-rays, and means for transferring thermal energy away from the track.

Another embodiment of the invention relates to a method for dissipating heat from an anode bombarded with electrons in an x-ray tube during operation of the x-ray tube. The method includes rotating a target surface to distribute the heat from the impact of electrons on the target surface and transferring heat away from the target surface using a target body with a cavity configured to transfer thermal energy away from the target surface.

Another embodiment of the invention relates to a method of assembling an x-ray tube having an x-ray tube casing, an anode assembly, a cathode assembly, and a target body. The method includes locating an x-ray tube casing, orienting an anode assembly and cathode assembly within the casing, and fastening a target body to the anode assembly. The target body has a cavity containing a working fluid for transferring thermal energy away from the anode assembly.

Other principle features and advantages of the present invention will become apparent to those skilled in the art upon review of the following drawings, the detailed description, and the appended claims.

BRIEF DESCRIPTION OF THE DRAWINGS

The invention will become more fully understood from the following detailed description, taken in conjunction with the accompanying drawings, wherein like reference numerals denote like elements, in which.

DETAILED DESCRIPTION OF THE INVENTION

Figure 1:
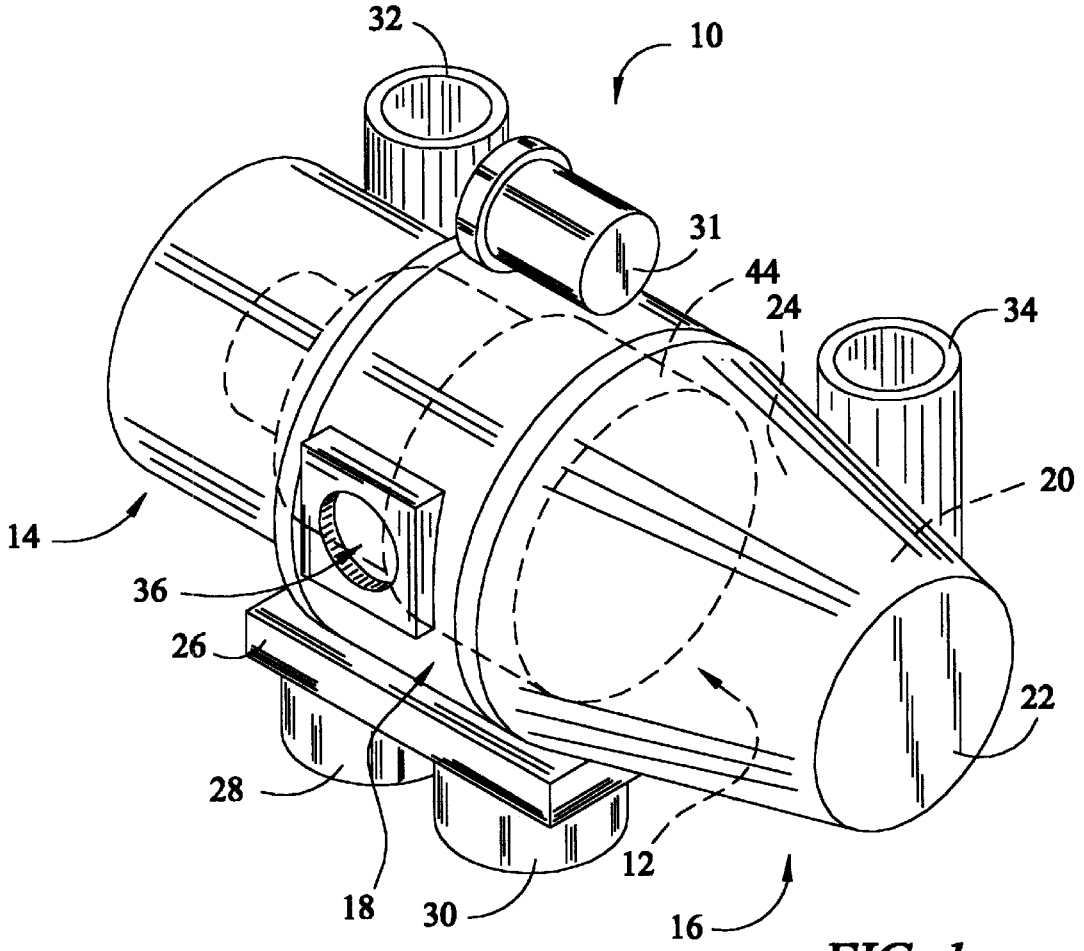
FIG. 1 is a perspective view of a housing having an x-ray tube in accordance with the present invention.

FIG. 1 illustrates a housing unit 10 for an x-ray generating device or x-ray tube insert 12. Housing unit 10 includes an anode end 14, cathode end 16, and a center section 18 positioned between anode end 14 and cathode end 16. X-ray generating device 12 is enclosed in a fluid chamber 20 within a casing 22.

Fluid chamber 20 generally is filled with a fluid 24, such as, dielectric oil, which circulates throughout housing unit 10 to cool x-ray generating device 12. Fluid 24 within fluid chamber 20 is cooled by a radiator 26 positioned to one side of center section 18. Fluid 24 moves throughout fluid chamber 20 and radiator 26 by a pump 31. Preferably, a pair of fans 28 and 30 are coupled to radiator 26 for providing cooling air flow over radiator 26 as hot fluid flows through radiator 26.

Electrical connections to x-ray generating device 12 are provided through an anode receptacle 32 and a cathode receptacle 34. X-rays emitted from x-ray generating device 12 pass through an x-ray transmissive window 36 in casing 22 at one side of center section 18.

Figure 2:
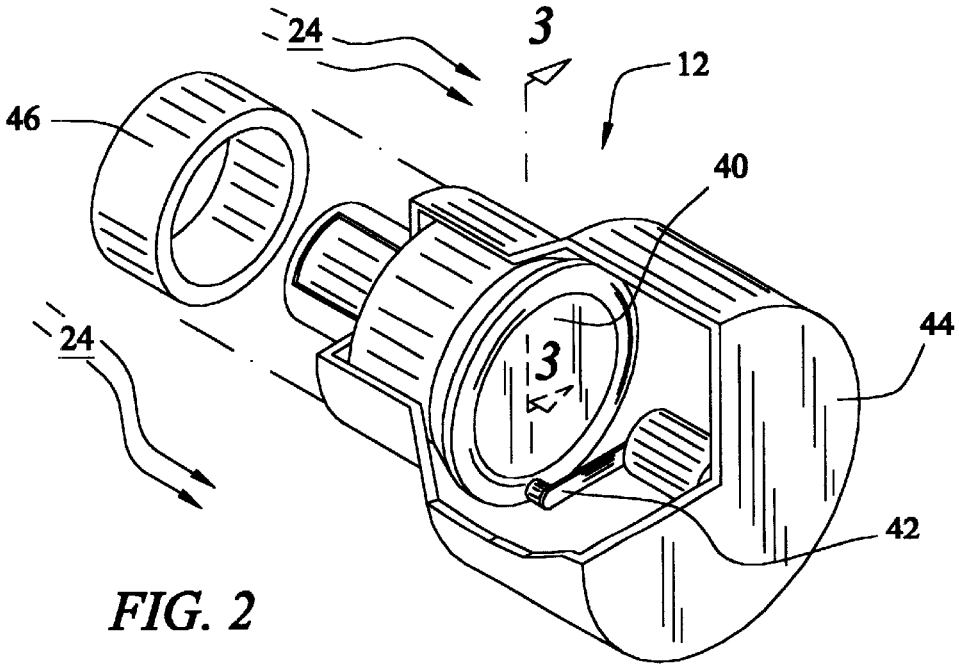
FIG. 2 is a sectional perspective view with the stator exploded to reveal a portion of an anode assembly of the x-ray tube of FIG. 1.

As shown in FIG. 2, x-ray generating device 12 includes a target anode assembly 40 and a cathode assembly 42 disposed in a vacuum within a vessel 44. A stator 46 is positioned over vessel 44 adjacent to target anode assembly 40. Upon the energization of the electrical circuit connecting target anode assembly 40 and cathode assembly 42, which produces a potential difference of, e.g., 60 kV to 140 kV, electrons are directed from cathode assembly 42 to target anode assembly 40. The electrons strike target anode assembly 40 and produce high frequency electromagnetic waves, or x-rays, and residual energy. The residual energy is absorbed by the components within x-ray generating device 12 as heat. The x-rays are directed out of casing 22 through window 36, which helps direct the x-rays toward the object being imaged (e.g., the patient).

Figure 3:
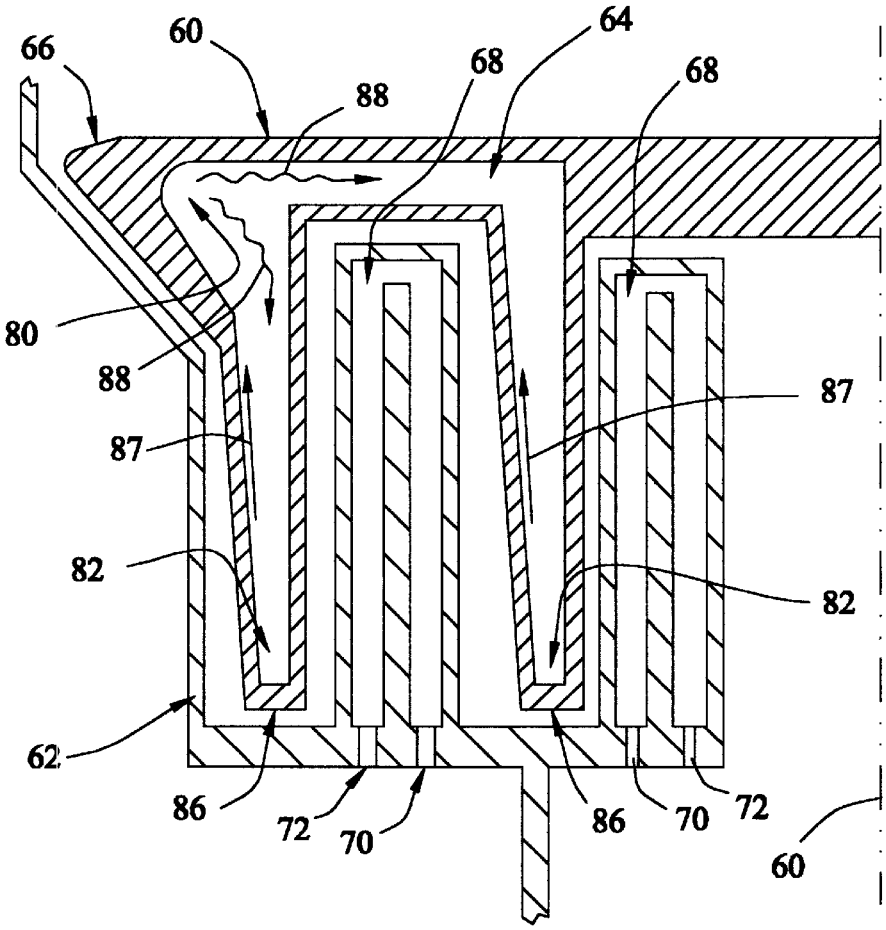
FIG. 3 is a cross sectional view of the anode assembly of the x-ray tube of FIG. 1.

FIG. 3 illustrates a cross sectional view of target anode assembly 40. Target anode assembly 40 includes a target 60, a frame 62, fins 86, and a cooling chamber 68. Target 60 is a metallic disk made of a dense material. Target 60 is preferably made of tungsten or a tungsten alloy. Target 60 includes a track 66 which provides a surface against which electrons from cathode assembly 42 strike. Frame 62 is a rigid casing which envelopes target 60.

In the production of x-rays by x-ray generating device 12, an electron beam is accelerated into track 66 of x-ray tube target 60. The electron bombardment deposits large amounts of heat into the track 66 region of target 60. The heat then is spread in the outer rim of target 60. When the heat makes contact with vapor chamber 64, the heat causes working fluid 87 in vapor chamber 64 to evaporate into vapors 88. Evaporator region 80 is a location with relatively higher vapor pressure, causing vapors 88 to move to condenser regions 82, where pressure is relatively lower.

Target 60 and fins 86 define a vapor chamber 64. Vapor chamber 64 is an annular hollow cavity within target anode assembly 40 containing a working fluid 87. Working fluid 87 of vapor chamber 64 is preferably sodium or lithium. Alternatively, working fluid 87 is potassium, water or other fluids. The main structure of vapor chamber 64 is made with a material compatible with working fluid 87. For example, if sodium or lithium is used as working fluid 87; tungsten, molybdenum or one of their alloys is preferably used for the vapor chamber walls.

Vapor chamber 64 transfers heat by vaporizing working fluid 87 at an evaporator region 80 near track 66, and liquefying the vaporized fluid at condenser regions 82 further from track 66. The walls of vapor chamber 64 taper from evaporator region 80 to condenser regions 82. As target 60 spins, the tapered structure helps to centrifuge working fluid 87 back to evaporator region 80 (i.e., the area near track 66). In addition, the inner surface of vapor chamber 64 may include a wick structure enhancing the surface area of vapor chamber 64 and, consequently, improving the ability to evaporate and condense working fluid 87. The large volume of vapor chamber 64 gives relatively little resistance to the flow of the vapor. Hence, vapor chamber 64 has a relatively uniform pressure and the evaporation and condensation will take place at nearly the same temperature. Thus, the entire vapor chamber is essentially isothermal.

In condenser regions 82 of target 60, vapors 88 of working fluid 87 condense because the walls are slightly cooler. During the condensation process, heat is given up to the walls of vapor chamber 64 and the heat is subsequently radiated to the walls of frame 62. The condensation process results in a relatively lower vapor pressure in condenser regions 82. Due to the pressure gradient in vapor chamber 64, the evaporated fluid (i.e., the vapors 88) will flow to the condenser regions 82 of fins 86.

Hence, heat is effectively transferred from the track region of target 60 to the slightly cooler condenser regions 82. The condensed fluid is then transferred back to evaporator region 80, closer to track 66. The transfer of fluid back to evaporator region 80 is aided by the spinning of target 60 during operation.

The fact that evaporation and condensation occur at approximately the same temperature effectively makes vapor chamber 64 isothermal. As such, the process utilized by vapor chamber 64 can quickly transfer the heat from the heated region of target 60 to condenser regions 82 with minimal thermal gradients in the walls of vapor chamber 64. This results in lower track 66 temperatures because the thermal storage of the rest of the anode is more effectively used.

Fins 86 provide a material surrounding condenser regions 82 to aid in the condensation of vapors 88. Fins 86 can be lengthened as necessary to develop the desired heat dissipation capability. If necessary, mass can be added to target 60 as necessary to aid in extremely high power transient x-ray exposures which exceed the average power rating of vapor chamber 64. The extra mass will temporarily store the heat energy for later dissipation.

The heat radiated by the outer surface of the vapor chamber walls is collected by frame 62. Frame 62 includes walls which closely conform to vapor chamber 64 at condenser regions 82. The vacuum side of both target 60 and frame 62 (i.e., the side opposite vapor chamber 64) can be modified to enhance the thermal emissivity of the surfaces. Frame 62 is cooled by either a water based, oil based or special thermal fluid liquid in cooling chamber 68. To enhance the heat transfer capability at the frame/coolant interface, extended surfaces are alternatively built in the structure to enhance mixing of the coolant and to increase the surface area used in the convection process. Coolant is forced through the walls of frame 62, passing through a coolant inlet 70 and exiting through a coolant outlet 72.

Advantageously, vapor chamber 64 provides greatly enhanced heat dissipation at target 60, resulting in the capability to do longer and more powerful x-ray scans. Further, vapor chamber 64 provides lower target temperatures. Even further, vapor chamber 64 provides lower mass and smaller targets for a given power rating, enabling higher gantry speeds on CT systems or better angulation on x-ray systems.

Figure 4:
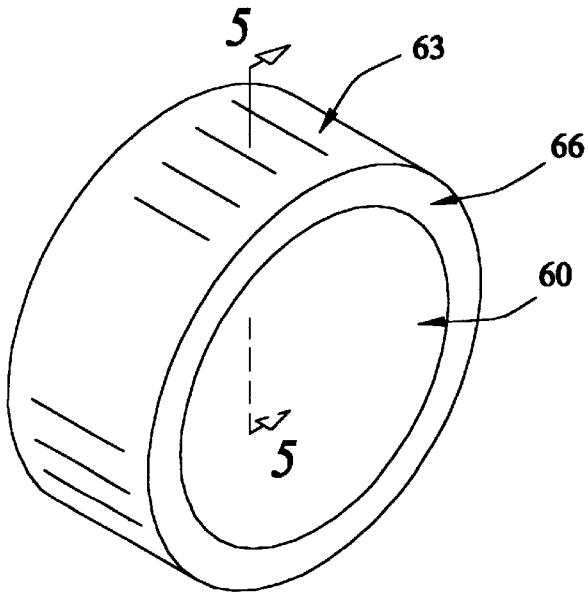
FIG. 4 is a perspective view of an alternative embodiment of a target of the anode assembly of the x-ray tube of FIG. 1.
Figure 5:
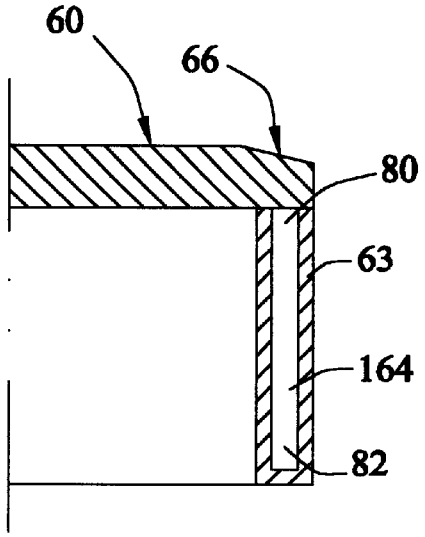
FIG. 5 is a partial view of a cross section of the target of the anode assembly of FIG. 4.

Referring now to the alternative embodiment shown in FIG. 4, target 60 now includes an extension 63 extending from track 66 in parallel to the rotational axis of target 60. Extension 63 provides an increased mass of material aiding in the storage of heat from track 66. Further, this concept may be easier to fabricate. In FIG. 5, a vapor chamber 165 is included as an integral part of extension 63, and is partially filled with a working fluid. Vapor chamber 165 operates to transfer thermal energy away from track 66 in much the same manner as vapor chamber 64 (i.e., by evaporating the working fluid at evaporator region 80 and condensing the resulting vapors at condenser region 82).

Vapor chamber 165 can be integrated into extension 63 by different methods. In an exemplary method, vapor chamber 165 is placed within a groove in extension 63. The groove is created by an electro-discharge machine (EDM). Such a method minimizes the number of brazes required in fabrication. In an alternative method, a series of individual heat pipes 165 are machined into extension 63. Heat pipe 165 is created within extension 63 by drilling or EDM'ing axially holes which accept heat pipe fluid. Such an alternative method aids in the fabrication process.

Figure 6:
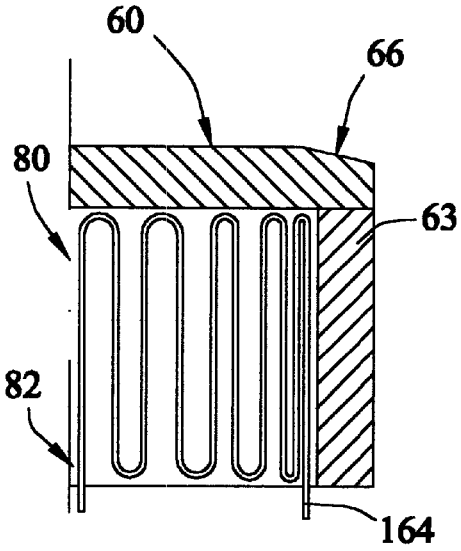
FIG. 6 is a partial view of a cross section of a third embodiment of the target of the anode assembly of FIG. 4.
Figure 7:
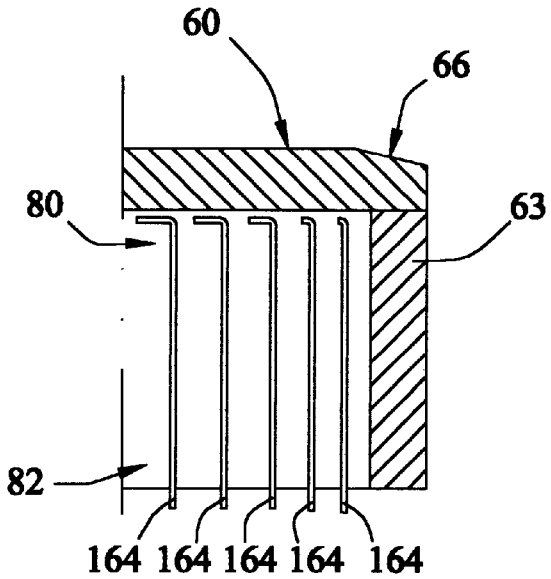
FIG. 7 is a partial view of a cross section of a fourth embodiment of the target of the anode assembly of FIG. 4.

Referring now to FIGS. 6 and 7, alternative embodiments are shown wherein heat pipes 164 are brazed into extension 63. Extension 63 is preferably graphite and provides greater thermal storage for a given mass compared to tungsten and TZM. In the embodiment shown in FIG. 7, one long coiled heat pipe 164 is provided. In the embodiment shown in FIG. 8, multiple heat pipes 164 are provided. A person of skill in the art would understand that a variety of such heat pipe configurations are possible.

Figure 8:
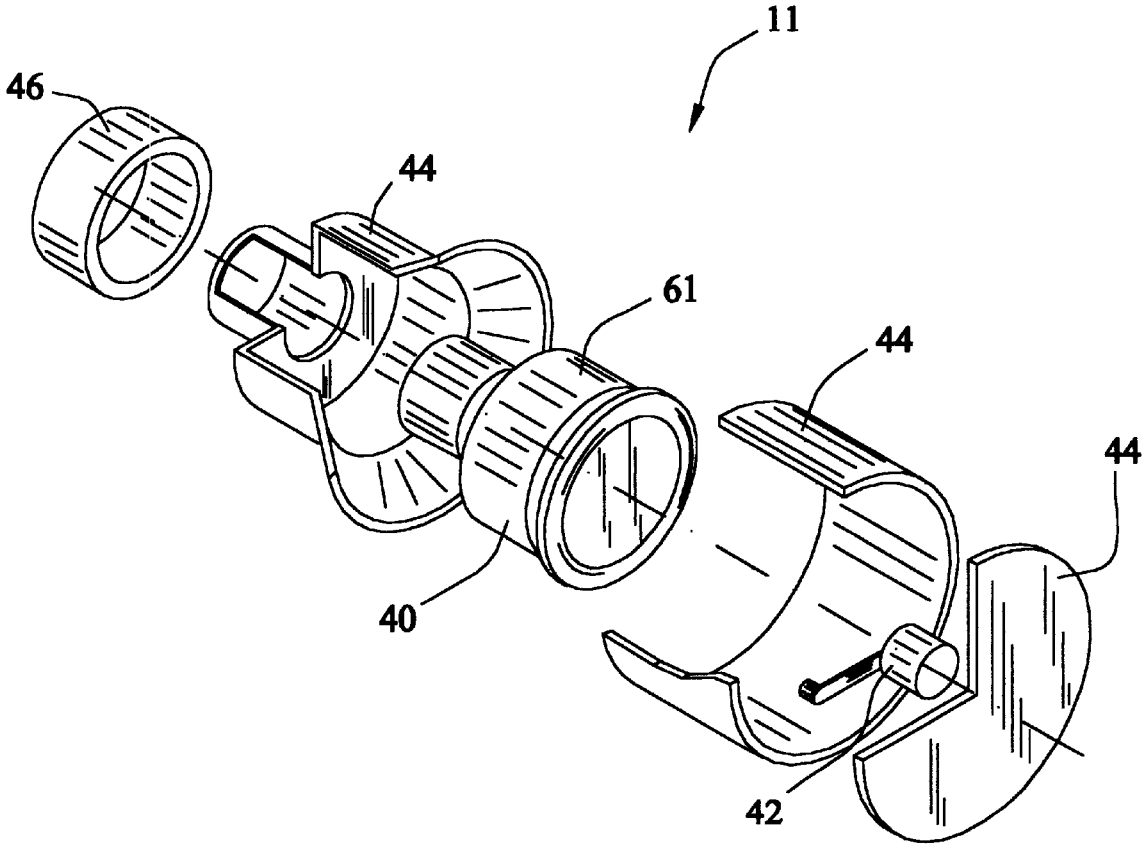
FIG. 8 is an exploded view with partial cutout of the x-ray tube of FIG. 1.

FIG. 8 illustrates a portion 11 of unassembled x-ray tube insert 12. Portion 11 includes target anode assembly 40, cathode assembly 42, vacuum vessel 44, and stator 46. The assembly of x-ray tube insert 12 includes locating vacuum vessel 44, orienting target anode assembly 40 and cathode assembly 42 within vacuum vessel 44, and fastening a target body 61 to anode assembly 40.

While the embodiments illustrated in the FIGURES and described above are presently preferred, it should be understood that these embodiments are offered by way of example only. Other embodiments may include vapor chambers or heat pipes in different sizes, numbers, and locations. The invention is not limited to a particular embodiment, but extends to various modifications, combinations, and permutations that nevertheless fall within the scope and spirit of the appended claims.

What is claimed is:

1. An x-ray tube for emitting x-rays which includes an anode assembly and a cathode assembly, the x-ray tube comprising:

a casing;

an anode assembly disposed in the casing and including a target surface;

a cathode assembly mounted in the casing at a distance from the anode assembly, the cathode assembly including an electron emitter which emits electrons, the electrons hitting the target surface of the anode assembly and producing x-rays; and a target body extending from the target surface of the anode assembly, the target body having an enclosed cavity extending normal to the target surface, the cavity containing a working fluid and configured to transfer thermal energy away from the target surface by vaporization of the working fluid.

2. The x-ray tube of claim 1, wherein the cavity of the target body has an annular shape.

3. The x-ray tube of claim 1, further comprising a highly conformal frame including cooling channels providing a flow of cooling fluid proximate an outer surface of the target body.

4. The x-ray tube of claim 1, wherein the target surface is configured to rotate to provide a rotating target surface upon which the electrons from the electron emitter hit and produce x-rays.

5. The x-ray tube of claim 4, wherein the cavity of the target body includes a tapered shape, the tapered shape directing the working fluid toward a track region of the target when the anode assembly rotates.

6. The x-ray tube of claim 1, wherein the cavity of the target body includes multiple fins.

7. The x-ray tube of claim 1, further comprising a heat pipe extending from the target surface.

8. The x-ray tube of claim 7, wherein the heat pipe is integral to the target body.

9. The x-ray tube of claim 1, wherein the target body comprises graphite.

10. The x-ray tube of claim 1, wherein the cavity of the target body includes internal walls having a capillary wick structure, the capillary wick structure providing for the transfer of the working fluid from a condenser region to an evaporator region.

11. The x-ray tube of claim 1, wherein the working fluid is any one of sodium, lithium, water, and potassium.

12. An x-ray tube for emitting x-rays with increased performance by effective heat dissipation, the x-ray tube comprising:

an electron source, the electron source emitting electrons;

an x-ray source, the x-ray source providing a track on a target surface for the electrons from the electron source to hit and produce x-rays; and enclosed means extending normal to the target surface for transferring thermal energy away from the track by vaporizing a fluid.

13. The x-ray tube of claim 12, wherein the means for transferring thermal energy away from the track includes a working fluid which receives thermal energy by vaporization.

14. The x-ray tube of claim 12, wherein the means for transferring thermal energy away from the track is integral to the x-ray source providing a track on a target surface for electrons.

15. The x-ray tube of claim 12, wherein the target surface is configured to rotate to provide a rotating track upon which the electrons from the electron source hit and produce x-rays.

16. The x-ray tube of claim 12, wherein the x-ray source includes cooling structures proximate the means for transferring thermal energy away from the track.

17. A method for dissipating heat from an anode bombarded with electrons in an x-ray tube during operation of the x-ray tube, the method comprising:

rotating a target surface to distribute the heat from the impact of electrons on a track of the target surface; and transferring heat away from the target surface using a target body with an enclosed cavity extending normal to the target surface, the cavity being configured to transfer thermal energy away from the target surface by vapor action.

18. The method of claim 17, wherein the step of transferring heat away from the target surface includes vaporizing a working fluid at an evaporation region of the cavity and liquefying the vaporized fluid at a condenser region of the cavity.

19. The method of claim 18, wherein the step of transferring heat away from the target surface includes transporting the condensed working fluid from the condenser region to the evaporator region.

20. A method of assembling an x-ray tube having a vacuum vessel; an anode assembly; a cathode assembly; and a target body, the method comprising:

locating an x-ray tube vacuum vessel;

orienting an anode assembly and cathode assembly within the vacuum vessel; and fastening a target body having a target surface to the anode assembly, the target body having an enclosed cavity extending normal to the target surface, the cavity containing a working fluid and configured to transfer thermal energy away from the anode assembly by vaporization of the working fluid.

21. The method of claim 20, including the steps of:

disposing the x-ray tube in packaging suitable for shipping; and shipping the packaged x-ray tube to a predetermined location.

* * * * *